US011552429B2

(12) United States Patent
Kumarswamy et al.

(10) Patent No.: US 11,552,429 B2
(45) Date of Patent: Jan. 10, 2023

(54) POWER PLUG RETENTION CLIP

(71) Applicant: SCHNEIDER ELECTRIC IT CORPORATION, Foxboro, MA (US)

(72) Inventors: Chandan Kumar Hosapete Kumarswamy, Bangalore (IN); Venu Gopal Mugur Anantha Krishna Murthy, Karnataka (IN)

(73) Assignee: SCHNEIDER ELECTRIC IT CORPORATION, Foxboro, MA (US)

( * ) Notice: Subject to any disclaimer, the term of this patent is extended or adjusted under 35 U.S.C. 154(b) by 99 days.

(21) Appl. No.: 17/232,314

(22) Filed: Apr. 16, 2021

(65) Prior Publication Data

US 2021/0328381 A1 Oct. 21, 2021

(30) Foreign Application Priority Data

Apr. 17, 2020 (IN) ..... 202011016582

(51) Int. Cl.
*H01R 13/639* (2006.01)

(52) U.S. Cl.
CPC ..... *H01R 13/639* (2013.01)

(58) Field of Classification Search
CPC ..... H01R 13/6392; H01R 13/639; H01R 13/6395
See application file for complete search history.

(56) References Cited

U.S. PATENT DOCUMENTS 2,266,560 A * 12/1941 Mansfield ..... H01R 13/6395 439/373
3,286,577 A * 11/1966 Weidner, Jr. ..... F16J 15/12 411/542
4,066,313 A * 1/1978 von dem Hagen .. H01R 13/639 439/471
4,618,200 A * 10/1986 Roberts ..... H01R 13/6395 439/367
4,652,069 A * 3/1987 Smith ..... H01R 13/6395 439/449
4,662,697 A * 5/1987 Moses ..... H01R 13/443 174/67
5,928,023 A * 7/1999 Buckner ..... H01R 13/6395 439/373
6,520,792 B2 * 2/2003 Chen-Chiang ..... H01R 13/6395 439/373

(Continued)

FOREIGN PATENT DOCUMENTS

EP 2806298 B1 4/2020

OTHER PUBLICATIONS

Extended European Search Report from corresponding European Application No. 21168441.0 dated Sep. 9, 2021.

*Primary Examiner* — Neil Abrams
(74) *Attorney, Agent, or Firm* — Lando & Anastasi, LLP

(57) ABSTRACT

A retention clip includes a clip body having a retention portion configured to releasably engage and releasably secure a plug. The retention portion includes clips extending from the clip body. The clips are configured to engage and releasably secure the clip body to the plug. The clip body further includes at least one post extending from the clip body. The at least one post is configured to secure the clip body to a connector element of a support structure by coupling with the connector element.

17 Claims, 6 Drawing Sheets

(56) References Cited

U.S. PATENT DOCUMENTS

| | | | | |
|---|---|---|---|---|
| 6,767,237 | B1 * | 7/2004 | Shih | H01R 13/6395 439/373 |
| 7,101,215 | B2 | 9/2006 | Woellner et al. | |
| 7,134,902 | B1 * | 11/2006 | Lewis | H01R 13/6395 439/372 |
| 7,470,141 | B2 * | 12/2008 | Yoest | H01R 13/6392 439/373 |
| 7,513,791 | B1 * | 4/2009 | Gary | H01R 13/6395 439/373 |
| 7,722,380 | B1 * | 5/2010 | West | H01R 13/6395 439/373 |
| 7,850,478 | B2 * | 12/2010 | Lin | H01R 13/6395 439/372 |
| 7,927,126 | B1 * | 4/2011 | Bender | B01J 19/10 439/458 |
| 8,337,236 | B2 * | 12/2012 | Shu | H01R 13/6395 439/369 |
| 8,926,358 | B2 * | 1/2015 | Kuo | H01R 13/6395 439/367 |
| 8,986,040 | B2 * | 3/2015 | Garofalo | H01R 13/6395 439/373 |
| 9,337,572 | B2 | 5/2016 | Maranto et al. | |
| 9,391,402 | B2 * | 7/2016 | Lin | H01R 13/6395 |
| 9,722,358 | B1 * | 8/2017 | Galpchian | H01R 13/6395 |
| 9,799,991 | B2 * | 10/2017 | Yi | H01R 13/6392 |
| 10,637,195 | B2 * | 4/2020 | Hsu | G06F 1/182 |
| 10,686,281 | B2 | 6/2020 | Chang et al. | |
| 10,910,771 | B2 * | 2/2021 | Yokosawa | H01R 13/6395 |
| 11,211,749 | B2 * | 12/2021 | Cave | H01R 13/6395 |
| 2013/0217255 | A1 | 8/2013 | Gong et al. | |
| 2014/0009876 | A1 * | 1/2014 | Wang | H01R 13/6395 361/679.01 |

* cited by examiner

POWER PLUG RETENTION CLIP

CROSS-REFERENCE TO RELATED APPLICATION

This application claims the benefit under 35 U.S.C. § 119 of Indian Patent Application No. 202011016582 filed Apr. 17, 2020, which is hereby incorporated herein by reference in its entirety for all purposes.

BACKGROUND

When it comes to electronics, electrical power is delivered to electronic equipment to power and operate the equipment. Power connectors often act as a link between a device and its source of power. Power connectors are devices that allow electrical current to pass through it for the purpose of providing power to a device. Power connectors can carry either alternating current (AC) or direct current (DC). AC plugs and sockets allow devices to be connected to the primary power supply. These types of plugs and sockets differ in voltage, current rating, size, and design, depending on the national standards.

IEC C13/C14 connectors are types of couplers (plug/sockets) used in power devices, such as uninterruptible power supplies (UPSs). A power cord with a suitable power plug on one end and a C13 connector (connecting to the UPS) on the other end is an example of one type of connector used to power the UPS. A UPS is typically used to protect hardware, such as computers, servers, telecommunication equipment or other electrical equipment where an unexpected power disruption could cause damage, including serious business disruption or data loss. Integrity of the power connectors with UPS is needed for continuous power supply.

Standard plugs or connectors come without any positive locking features, which increases the chances of frequent disconnection/loose connection, especially if the product is meant for internal mobility. This may result in safety concerns as well as customer dissatisfaction as the disconnection of input connection will result in non-charging state of the device/backup.

SUMMARY

One aspect of the present disclosure is directed to a retention clip comprising a clip body including a retention portion. The retention portion is adapted to engage a plug and secure the plug to a device.

Another aspect of the present disclosure is directed to a retention clip comprising a clip body including a retention portion adjustably attached to an extendable portion. The retention portion is adapted to engage a power plug and secure the power plug to a power distribution device in a substantially vibration proof engagement. The extendable portion is adapted to elongate and retract the clip body.

Embodiments of the retention clip further may include the retention portion having at least one clip projecting from the clip body at one end of the clip body. The clip body further may include at least one post projecting from the clip body at an opposite end of the clip body. The at least one post may be configured to be received within a connector element. The clip body further may include at least one release lever configured to manipulate the at least one clip. The at least one clip may include two clips and the at least one release lever includes two release levers. The release levers may be configured to be pressed inwardly with the clips spanning a cable portion of the cable connector and engaging the cable portion of the cable connector when released. The clips may be part of a structure that is received and secured within a channel of the clip body to extend the clip body between a retracted position and an extended position. The structure may include at least one tab configured to be manipulated to extend and retract the structure and the clips.

Yet another aspect of the present disclosure is directed to an assembly comprising a power distribution device including a socket, a support structure configured to support the power distribution device, a cable connector including a plug configured to be coupled to the socket of the power distribution device, and a retention clip. In one embodiment, the retention clip includes a clip body including a retention portion adjustably attached to an extendable portion. The retention portion is adapted to engage the plug and secure the plug to the power distribution device in a substantially vibration proof engagement. The extendable portion is adapted to elongate and retract the clip body.

Embodiments of the assembly further may include the retention portion having at least one clip projecting from the clip body at one end of the clip body. The clip body further may include at least one post projecting from the clip body at an opposite end of the clip body. The at least one post may be configured to be received within a connector element of the support structure. The clip body further may include at least one release lever configured to manipulate the at least one clip. The at least one clip may include two clips and the at least one release lever includes two release levers. The release levers may be configured to be pressed inwardly with the clips spanning a cable portion of the cable connector and engage the cable portion of the cable connector when released. The clips may be part of a structure that is received and secured within a channel of the clip body to extend the clip body between a retracted position and an extended position. The structure may include at least one tab configured to be manipulated to extend and retract the structure and the clips.

One aspect of the present disclosure is directed to a retention clip comprising a clip body including a retention portion configured to releasably engage and releasably secure a plug. The retention portion includes clips extending from the clip body. The clips are configured to engage and releasably secure the clip body to the plug. The clip body further includes at least one post extending from the clip body. The at least one post is configured to secure the clip body to a connector element of a support structure by coupling with the connector element.

Embodiments of the retention clip further may include a planar clip body, with the clips extending along a plane perpendicular to a plane of the clip body. The clip body further may include release levers configured to manipulate the clips to release the clips from the plug. The release levers may be configured to be pressed inwardly to disengage the clips from the plug. The release levers may be each provided with a flange that enables a user to leverage the release levers to disengage the clips. The clips may be configured to include a snap feature to grip the plug in place. The clips may extend downwardly from one end of the clip body and the at least one post may extend downwardly from an opposite end of the clip body. The at least one post may be cylindrical in construction. The at least one post may be configured with a guiding feature to guide the at least one post into the connector element of the support structure. The guiding feature may include a tapered end to facilitate the post entering into the connector element. The clips may be part of a structure that is received and secured within a channel of the clip body to extend the clip body and a distance between the clips and the at least one post. The structure may include tabs configured to be manipulated to extend and retract the structure and the clips. Release levers, when in an unstressed position, can be configured to maintain pressure against the tabs to hold the structure in place thereby locking the clips at a desired position with respect to the clip body and the at least one post.

Another aspect of the present disclosure is directed to a method of securing a plug within a socket of a device. In one embodiment, the method comprises positioning at least one post of a retention clip in a connector element of a support structure; and securing a retention portion of the retention clip to the plug, the retention clip comprising a clip body including clips extending from the clip body, the clips being configured to engage and releasably secure the retention clip to the plug.

Embodiments of the method further may include, when securing the retention clip to the plug, pressing release levers of the retention clip inwardly to move the clips outwardly to span a cable portion of the plug. When removing the retention clip from the plug, the release levers may be pressed inwardly to move the clips outwardly away from the cable portion of the plug to release the retention clip from the plug. As the retention clip is moved away from the plug, the clips may be configured to move over the cable portion of the plug and the at least one post may be removed from the connector element. Once the plug retention clip clears the plug, the plug can be released or moved out of the socket.

Yet another aspect of the present disclosure is directed to a retention clip configured to secure a cable connector to a UPS supported on a support structure having at least one connector element. In one embodiment, the retention clip comprises a clip body including a retention portion having downwardly projecting clips provided at one end of the clip body to engage and releasably secure the retention clip to the cable connector. The clip body further includes at least one downwardly extending post provided at an opposite end of the clip body. The at least one post is configured to releasably secure the clip body to the connector element of the support structure.

Embodiments of the retention clip further may include configuring the clip body to include release levers to manipulate the clips, the release levers being configured to be pressed inwardly to secure the clips to the cable connector and to disengage the clips from the cable connector. The release levers may be each provided with a flange that enables a user to leverage the release levers to disengage the clips. The clips may be part of a structure that is received and secured within a channel of the clip body to extend the clip body and a distance between the clips and the at least one post. The structure may include tabs configured to be manipulated to extend and retract the structure and the clips. The release levers, when in an unstressed position, may be configured to maintain pressure against the tabs to hold the structure in place thereby locking the clips at a desired position with respect to the clip body and the at least one post.

DRAWINGS

These accompanying drawings are not intended to be drawn to scale. In the drawings, each identical or nearly identical component that is illustrated with various figures, are represented by a line numeral. For purposes of clarity, not every component may be labeled in every drawing. In the drawings.

DETAILED DESCRIPTION

This disclosure is not limited in its application to the details of construction and the arrangement of components set forth in the following descriptions or illustrated by the drawings. The disclosure is capable of other embodiments and of being practiced or of being carried out in various ways. Also, the phraseology and terminology used herein is for description purposes and should not be regarded as limiting. The use of "including," "comprising," "having," "containing," "involving," and variations herein, are meant to be open-ended, i.e. "including but not limited to."

Embodiments of a power plug retention clip are configured to provide a positive locking solution for input power connectors, e.g., C13/C14 connectors, within a power distribution device, such as an uninterruptible power supply (UPS). The power plug retention clip is further configured to ensure that the plug, e.g., C13 connector, is inserted fully into the socket, e.g., C14 receptacle. The power plug retention clip is further configured to avoid intermittent contact and prevent safety issues. The power plug retention clip includes a vibration proof design.

In one embodiment, the plug retention clip includes a clip body having a retention portion, e.g., clips, adjustably attached to or formed as a part of an extendable portion. The retention portion is adapted to engage a power plug and secure the power plug to a power distribution device in a substantially vibration proof engagement. The extendable portion is adapted to elongate and retract the clip body.

Figure 1:
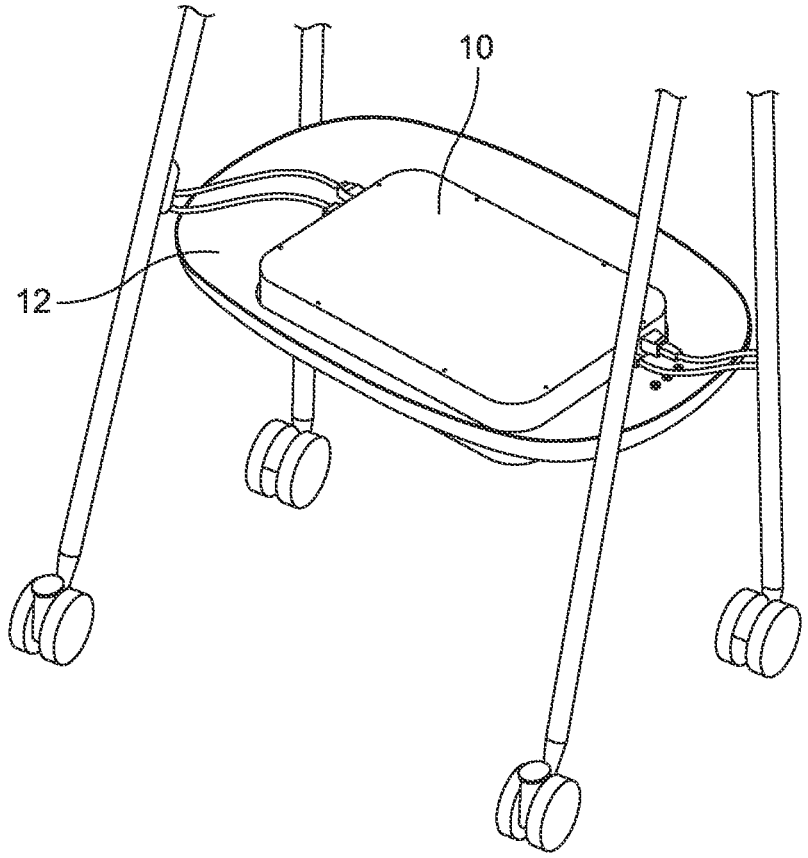
FIG. 1 is a perspective view of a power distribution device, such as an uninterruptible power supply (UPS), positioned within a support structure.

Referring to the drawings, and more particularly FIG. 1, a UPS 10 is shown being positioned within a support structure 12. As shown, the support structure 12 can be in the form of a tray having a flat bottom on which the UPS rests. It should be understood that the UPS 10 can be any type of power device that is configured to provide power to a load. Further, the support structure 12 can embody any type of structure that is capable of support the UPS 10 or any other type of power device.

Figure 2:
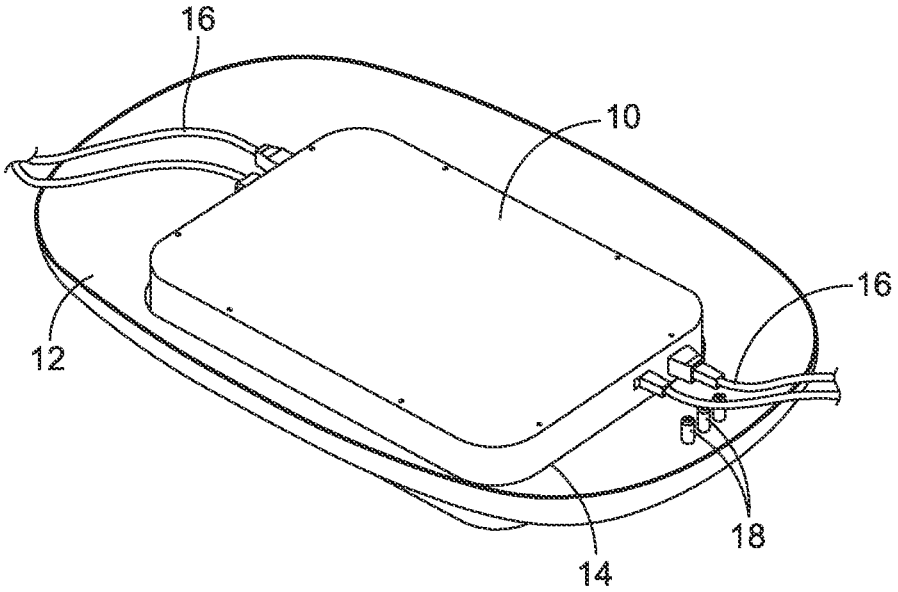
FIG. 2 is an enlarged perspective view of the UPS on the support structure.

Referring to FIG. 2, the tray 12 includes a bottom 14 that is contoured so that the UPS 10 is positioned centrally within the tray. As shown, several cable connectors, each indicated at 16, are provided to connect the UPS 10 to associated electronic equipment. The tray 12 further includes several cable connector elements 18 in the form of vertically oriented cylindrical elements, which as will be described in greater detail below are provided to secure the cable connector 16 to the UPS 10 once connected. Other types of connector elements 18 can be provided as well.

Figure 3:
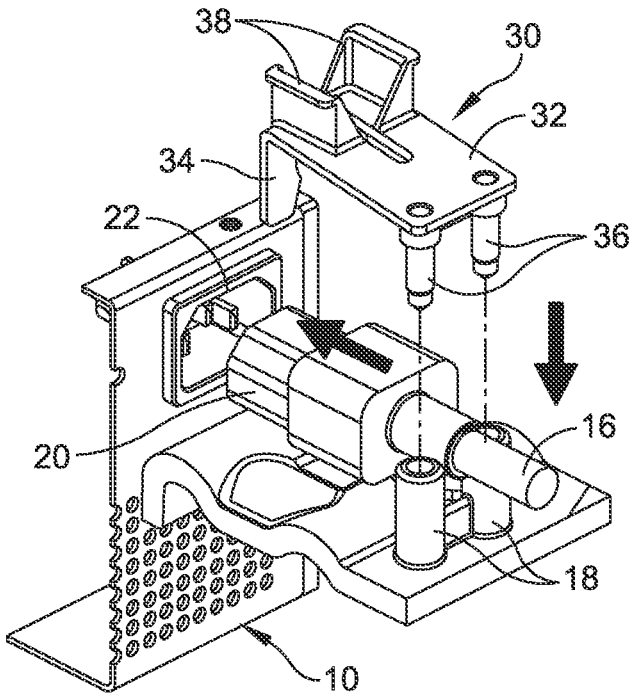
FIG. 3 is an exploded perspective view of a plug of a cable connector prior to being received within a socket of the UPS, and a plug retention clip of an embodiment of the present disclosure in a position prior to being secured to the cable connector.
Figure 4:
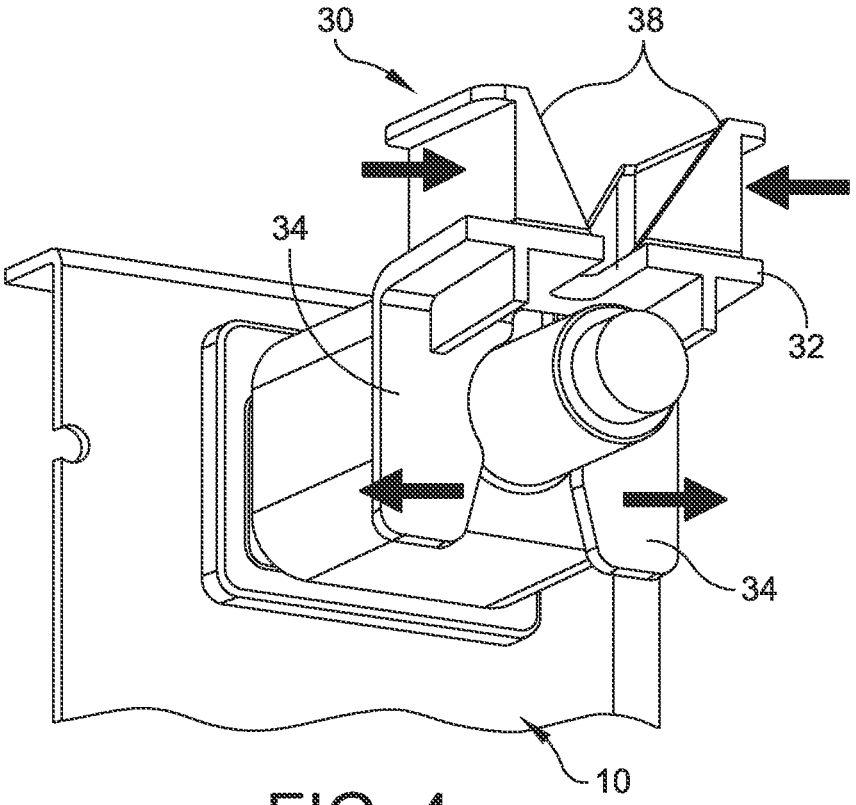
FIG. 4 is a perspective cross-sectional view of the plug of the cable connector received within the socket of the UPS, which is secured using the plug retention clip to retain the cable connector in place.

Referring to FIGS. 3 and 4, a plug 20 of a cable connector 16 is shown prior to being received within a socket 22 of the UPS 10. As shown, a plug retention clip of an embodiment of the present disclosure, generally indicated at 30, is provided to retain the cable connector 16 in place to ensure that plug 20 is received within the socket 22. The plug retention clip 30 includes a clip body 32 having two downwardly projecting clips, each indicated at 34, provided at one end of the clip body to adjustably engage and secure the plug retention clip to the cable connector 16. The clip body 32 further has two downwardly projecting posts 36 provided at an opposite end of the clip body to secure the clip body to the connector elements 18 of the tray 12. In one embodiment, the clip body 32 is planer, with the clips 34 extending along a plane perpendicular to the plane of the clip body. The posts 36 are cylindrical in construction, but can be configured in any suitable shape, e.g., rectangular. In the shown embodiment, each connector element 18 includes a cylindrical body that is sized to receive a respective post 36 when inserting the posts into the connector elements. Once inserted, the posts prevent lateral movement of the clip body 32 and the plug retention clip 30 to prevent the plug 20 from moving with respect to the socket 22.

The clip body 32 further includes two release levers, each indicated at 38, configured to manipulate the clips 34. Referring additionally to FIG. 4, the release levers 38 can be pressed inwardly to disengage the clips 34 from the cable connector 16 to release the plug retaining clip 30 from the plug 20 of the cable connector. As the release levers 38 are pressed inwardly toward one another, the clips 34 are moved outwardly away from each other. The clips 34 of the plug retention clip 30 include rounded portions that are configured to engage a cable portion of the cable connector 16 when applied to the cable connector.

During use, the plug retention clip 30 is used to secure the plug 20 of the cable connector 16 to the socket 22 of the UPS 10 and the tray 12, specifically the connector elements 18. As shown, when applying the plug retention clip 30 to the cable connector 16, the release levers 38 are pressed inwardly with the clips 34 spanning the cable portion of the cable connector and the posts 36 positioned to enter the connector elements 18. As the clips 34 move over the cable portion of the cable connector 16, the posts 36 enter their respective connector elements 18 until the clips 34 completely surround the cable portion and the posts are completely received in the connector elements. At this point the release levers 38 can be released by the user to allow the clips 34 to move toward one another to engage the cable connector 16. In this position, the plug retention clip 30 secures the cable connector 16 to the UPS 10 and the tray 12.

To release the plug retention clip 30, the release levers 38 are pressed toward one another to move the clips 34 outwardly away from the cable portion of the cable connector 16 to disengage the clips from the cable portion of the cable connector. The plug retention clip 30 is moved away from the cable connector 16, with the clips 34 moving over the cable portion and the posts 36 being removed from the connector elements 18. Once the plug retention clip 30 clears the cable connector 16 and the posts 36 are removed from the connector elements 18, the plug 20 of the cable connector 16 can be released or moved out of the socket 22 of the UPS 10.

Figure 5:
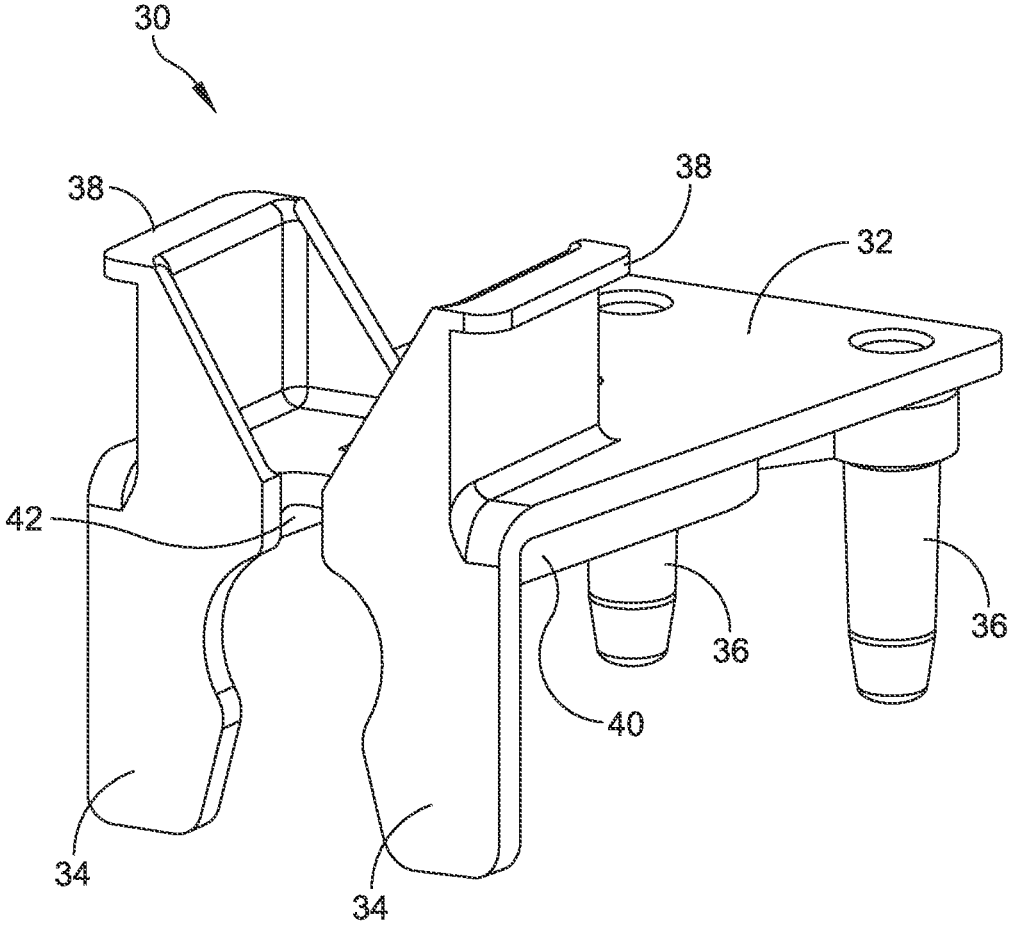
FIG. 5 is an enlarged perspective view of the plug retention clip.

Referring to FIG. 5, the clips 34, the posts 36 and the release levers 38 of the plug retention clip 30 are shown in greater detail. As shown, the clips 34 are configured to include a snap feature to grip the cable connector in place 16 when securing the clips to the cable connector. Each post 36 is configured with a pilot/guiding feature to provide easy guiding and locking when the plug retention clip is in the secured position. Each post 36 has a tapered end to facilitate the post entering into the connector element. The release levers 38 are each provided with a flange that enables the user to leverage the release levers to disengage the clips.

Figure 6A:
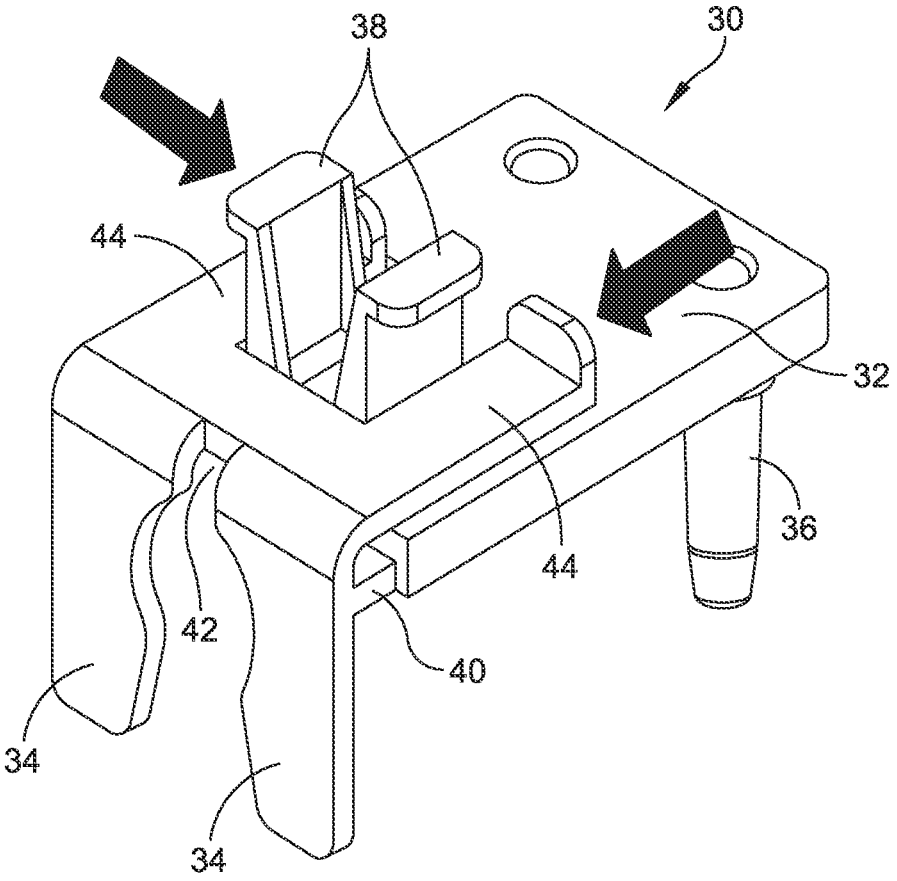
FIGS. 6A and 6B are perspective and side views, respectively, showing the plug retention clip in a retracted position.
Figure 6B:
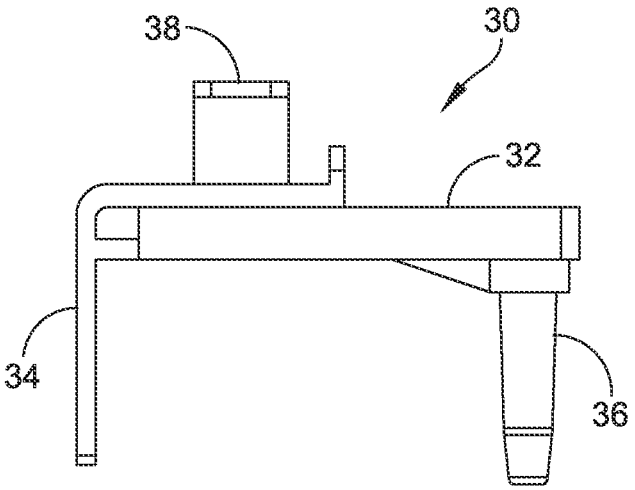
Figure 7A:
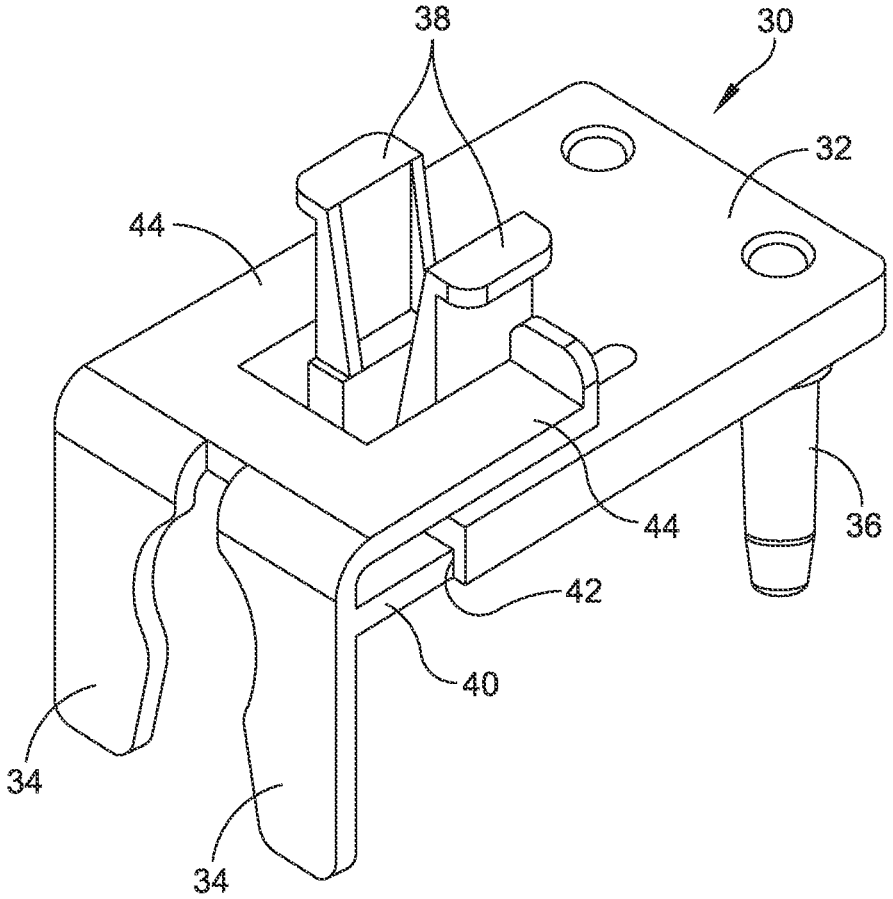
FIGS. 7A and 7B are perspective and side views, respectively, showing the plug retention clip in an extended position.
Figure 7B:
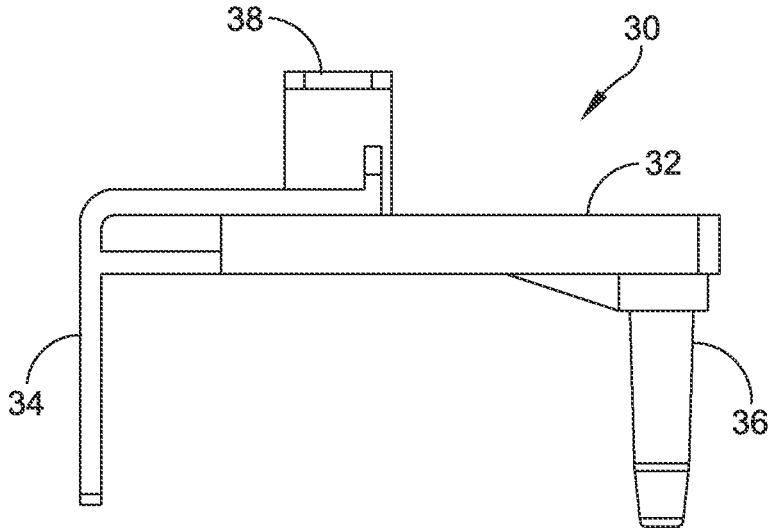

Referring to FIGS. 6A and 6B and to FIGS. 7A and 7B, the plug retention clip 30 is further configured to be moved between a retracted position (FIGS. 6A and 6B) and an extended position (FIGS. 7A and 7B). As shown, the clips 34 are part of a structure 40 that is received and secured within a channel 42 of the clip body 32 to extend the clip body and the distance between the clips 34 and the posts 36. The structure 42 includes two tabs, each indicated at 44, that the user can manipulate to extend and retract the structure and thus the clips 34. The release levers 38, when in an unstressed position, maintain pressure against the tabs 44 to hold the structure in place thereby locking the clips 34 at a desired position with respect to the clip body 32 and the posts 36. In one embodiment, in the retracted position (FIGS. 6A and 6B), the clips 34 are spaced from the posts 36 approximately 40 millimeters (mm). In the extended position (FIGS. 7A and 7B), the clips 34 are spaced from the posts 36 approximately 47 mm. The clip body 32 and the structure 40 can be modified to increase or decrease the spacing between the clips 34 and the posts 36.

In some embodiments, the release levers 38 and the tabs 44 can be configured to interact with one another to maintain the structure 40 in place. In one embodiment, a surface of the release levers 38 includes a structure that interfaces with a structure on a surface of the tabs 44 that faces the surface of the release levers. For example, the surface of the release levers 38 can be formed to include teeth that mate with teeth formed on the surface of the tabs 44 to maintain the structure 40 in place. When the release levers 38 are pressed inwardly to disengage the clips 34 from the cable connector 16 to release the plug retaining clip 30 from the plug 20 of the cable connector, the teeth of the release levers 38 disengage the teeth of the tabs 44.

In some embodiments, the size and shape of the plug retention clip 30 can be configured to accommodate varying types of cable connectors. For example, the plug retention clip 30 can be configured to accommodate C15 and C17 connectors. In certain embodiments, the plug retention clip 30 can be configured to be used with any device and any type of plug that is connected to a socket of the device.

Figure 8A:
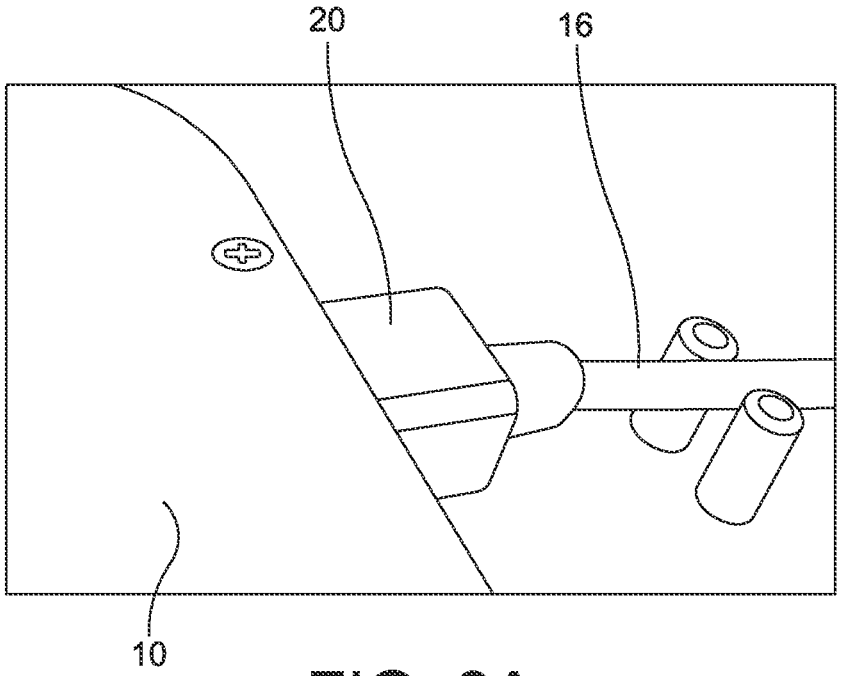
FIG. 8A is a perspective view of the plug of the cable connector received within the socket of the UPS.
Figure 8B:
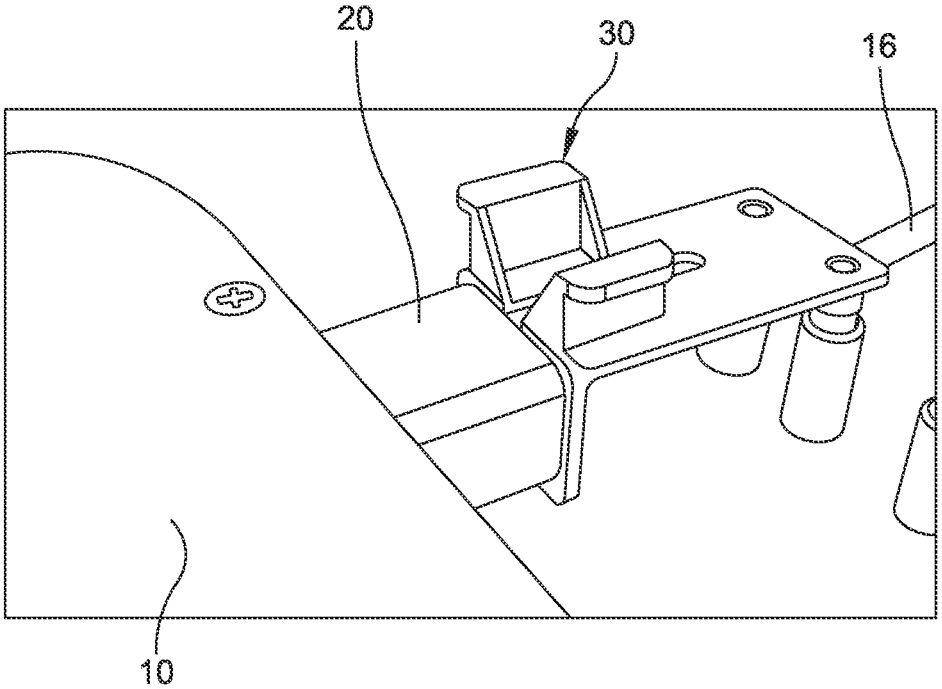
FIG. 8B is a perspective view of the plug retention clip applied to the cable connector shown in FIG. 8A.

FIG. 8A shows the plug 20 of the cable connector 16 received within the socket 22 of the UPS 10 to connect the cable connector to the UPS. FIG. 8B shows the plug retention clip 30 applied to the cable connector 16 to secure the cable connector in place.

In some embodiments, the plug retention clip 30 is fabricated from polymeric material. For example, the plug retention clip 30 can be fabricated from polyurethane or similar materials.

In some embodiments, the plug retention clip 30 is configured to secure and lock the plug 20 of the cable connector 16 to the UPS 10.

In some embodiments, the plug retention clip 30 is configured to avoid accidental disconnection of the plug 20 of the cable connector 16 from the socket 22 of the UPS.

In some embodiments, the plug retention clip 30 is configured to ensure the plug 20 of the cable connector 16 is fully inserted, with the plug retention clip ensuring full engagement within the socket 22 of the UPS 10.

In some embodiments, the plug retention clip 30 is easy to use, i.e., to attach and disconnect to the cable connector 16 and the support structure 12.

In some embodiments, the plug retention clip 30 is configured to attach and disconnect using a single hand.

In some embodiments, the plug retention clip 30 is configured to attach and disconnect without the use of tools.

In some embodiments, the plug retention clip 30 is configured to substantially eliminate vibration of the plug 20 of the connector cable 16, thereby preventing the plug of the cable connector from dislodging or intermittent contact within the socket 22 of the UPS 10 to improve reliability.

Embodiments of the plug retention clip can be used to connect any type of connector having a plug that is received within a socket. Further, the plug retention clip can be used on any type of electronic device.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the disclosure. Accordingly, the foregoing description and drawings are by way of example only.

What is claimed is:

1. A retention clip comprising:

a clip body including a retention portion configured to releasably engage and releasably secure a plug, the retention portion including clips extending from the clip body, the clips being configured to engage and releasably secure the clip body to the plug, and at least one post extending from the clip body, the at least one post being configured to secure the clip body to a connector element of a support structure by coupling with the connector element, wherein the clips extend downwardly from one end of the clip body and the at least one post extends downwardly from an opposite end of the clip body.

2. The retention clip of claim 1, wherein the clip body is planar, with the clips extending along a plane perpendicular to a plane of the clip body.

3. The retention clip of claim 1, wherein the clip body further includes release levers configured to manipulate the clips to release the clips from the plug.

4. The retention clip of claim 3, wherein the release levers are configured to be pressed inwardly to disengage the clips from the plug.

5. The retention clip of claim 3, wherein the release levers are each provided with a flange that enables a user to leverage the release levers to disengage the clips.

6. The retention clip of claim 1, wherein the clips are configured to include a snap feature to grip the plug in place.

7. The retention clip of claim 1, wherein the at least one post is cylindrical in construction.

8. The retention clip of claim 1, wherein the at least one post is configured with a guiding feature to guide the at least one post into the connector element of the support structure.

9. The retention clip of claim 8, wherein the guiding feature includes a tapered end to facilitate the post entering into the connector element.

10. A retention clip comprising:

a clip body including a retention portion configured to releasably engage and releasably secure a plug, the retention portion including clips extending from the clip body, the clips being configured to engage and releasably secure the clip body to the plug, and at least one post extending from the clip body, the at least one post being configured to secure the clip body to a connector element of a support structure by coupling with the connector element, wherein the clips are part of a structure that is received and secured within a channel of the clip body to extend the clip body and a distance between the clips and the at least one post, wherein the structure includes tabs configured to be manipulated to extend and retract the structure and the clips, and wherein release levers, when in an unstressed position, maintain pressure against the tabs to hold the structure in place thereby locking the clips at a desired position with respect to the clip body and the at least one post.

11. A method of securing a plug within a socket of a device, the method comprising:

positioning at least one post of a retention clip in a connector element of a support structure; and securing a retention portion of the retention clip to the plug, the retention clip comprising a clip body including clips extending from the clip body, the clips being configured to engage and releasably secure the retention clip to the plug, wherein the clips extend downwardly from one end of the clip body and the at least one post extends downwardly from an opposite end of the clip body.

12. A retention clip configured to secure a cable connector to a UPS supported on a support structure having at least one connector element, the retention clip comprising:

a clip body including a retention portion having downwardly projecting clips provided at one end of the clip body to engage and releasably secure the retention clip to the cable connector, and at least one downwardly extending post provided at an opposite end of the clip body, the at least one post being configured to releasably secure the clip body to the connector element of the support structure.

13. The retention clip of claim 12, wherein the clip body further includes release levers configured to manipulate the clips, the release levers being configured to be pressed inwardly to secure the clips to the cable connector and to disengage the clips from the cable connector.

14. The retention clip of claim 13, wherein the release levers are each provided with a flange that enables a user to leverage the release levers to disengage the clips.

15. The retention clip of claim 12, wherein the clips are part of a structure that is received and secured within a channel of the clip body to extend the clip body and a distance between the clips and the at least one post.

16. The retention clip of claim 15, wherein the structure includes tabs configured to be manipulated to extend and retract the structure and the clips.

17. The retention clip of claim 16, wherein the release levers, when in an unstressed position, maintain pressure against the tabs to hold the structure in place thereby locking the clips at a desired position with respect to the clip body and the at least one post.

* * * * *